US009480313B1

(12) United States Patent
Cullinane

(10) Patent No.: US 9,480,313 B1
(45) Date of Patent: Nov. 1, 2016

(54) UMBRELLA WITH OFF-CENTERED CANOPY

(71) Applicant: Barry J. Cullinane, Highland Mills, NY (US)

(72) Inventor: Barry J. Cullinane, Highland Mills, NY (US)

( * ) Notice: Subject to any disclaimer, the term of this patent is extended or adjusted under 35 U.S.C. 154(b) by 175 days.

(21) Appl. No.: 14/284,873

(22) Filed: May 22, 2014

Related U.S. Application Data

(60) Provisional application No. 61/928,679, filed on Jan. 17, 2014.

(51) Int. Cl.

| | |
|---|---|
| ***A45B 7/00*** | (2006.01) |
| ***A45B 25/10*** | (2006.01) |
| ***A45B 17/00*** | (2006.01) |
| ***A45B 25/00*** | (2006.01) |
| *A45B 23/00* | (2006.01) |

(52) U.S. Cl.
CPC ..... *A45B 7/005* (2013.01); *A45B 25/00* (2013.01); *A45B 17/00* (2013.01); *A45B 2023/0043* (2013.01); *A45B 2025/105* (2013.01)

(58) Field of Classification Search
CPC .. A45B 7/00; A45B 7/005; A45B 2011/005; A45B 2017/005; A45B 19/08; A45B 2023/0031; A45B 2023/0043; A45B 2023/0068; A45B 2025/105
USPC ..... 135/74, 20.1
See application file for complete search history.

(56) References Cited

U.S. PATENT DOCUMENTS

| | | | | | |
|---|---|---|---|---|---|
| 96,777 | A * | 11/1869 | Clyde | A45B 23/00 | 135/20.1 |
| 738,554 | A * | 9/1903 | Lingel | A45B 17/00 | 135/20.1 |
| 845,742 | A * | 3/1907 | Berger | A45B 9/00 | 135/20.1 |
| 1,006,454 | A * | 10/1911 | Bair | A45B 17/00 | 135/20.1 |
| 1,042,658 | A * | 10/1912 | Dunnenberger et al. | A45B 17/00 | 135/20.1 |
| 1,078,414 | A * | 11/1913 | Carrau | A45B 17/00 | 135/74 |
| 1,093,160 | A * | 4/1914 | Wagner | A45B 23/00 | 135/20.1 |
| 1,226,877 | A * | 5/1917 | Gautschy | A45B 17/00 | 135/74 |

(Continued)

FOREIGN PATENT DOCUMENTS

| | | | | |
|---|---|---|---|---|
| CH | FR 477401 A | * | 10/1915 | A45B 7/005 |
| DE | 865945 C | * | 2/1953 | A45B 7/005 |

(Continued)

*Primary Examiner* — David R Dunn
*Assistant Examiner* — Danielle Jackson
(74) *Attorney, Agent, or Firm* — Robert C. Montgomery; Montgomery Patent & Design LP

(57) ABSTRACT

An umbrella having a shaft assembly that includes a lower shaft, an upper shaft, an offset hinge assembly disposed between the lower and upper shafts, and a handle is provided. The umbrella also includes a canopy assembly with a plurality of extendable ribs operatively disposed between the distal end of the upper shaft and the runner. The canopy is operatively disposed over the ribs and affixed to a distal end of the upper shaft and the runner wherein the offset hinge assembly is adapted to be selectively positioned in a stowed position in which said canopy can be opened and closed, and in a deployed position in which said open canopy is offset from said handle.

11 Claims, 5 Drawing Sheets

(56) References Cited

U.S. PATENT DOCUMENTS

| | | | | | |
|---|---|---|---|---|---|
| 1,534,820 | A * | 4/1925 | Walmsley | A45B 7/005 | 135/74 |
| 1,701,067 | A * | 2/1929 | Finver | A45B 25/18 | 135/33.5 |
| 2,149,059 | A * | 2/1939 | Leon | A45B 7/005 | 135/74 |
| 2,528,578 | A * | 11/1950 | Clapper | A45B 7/005 | 135/20.1 |
| 2,605,778 | A * | 8/1952 | Clapper | A45B 17/00 | 135/20.1 |
| 2,633,856 | A * | 4/1953 | Weaklend | A45B 7/005 | 135/20.1 |
| 2,948,289 | A | 8/1960 | Owczarek | | |
| 3,204,650 | A * | 9/1965 | Shinew | A45B 11/02 | 135/16 |
| 3,765,434 | A * | 10/1973 | Riggs | A45B 7/005 | 135/16 |
| 5,505,221 | A | 4/1996 | Gao | | |
| 5,878,763 | A | 3/1999 | Tsai | | |
| D419,759 | S | 2/2000 | Goudarzi | | |
| 6,196,244 | B1 | 3/2001 | Haddad et al. | | |
| 6,216,712 | B1 * | 4/2001 | Lin | A45B 25/08 | 135/23 |
| 7,350,530 | B2 | 4/2008 | Lisciandro et al. | | |
| D580,072 | S | 11/2008 | Lenahan | | |
| 7,814,920 | B2 | 10/2010 | Lenahan | | |
| 2012/0180832 | A1 * | 7/2012 | Zheng | A45B 17/00 | 135/20.1 |

FOREIGN PATENT DOCUMENTS

| | | | | | |
|---|---|---|---|---|---|
| DE | 2320632 | A1 * | 11/1973 | A45B 11/00 | |
| DE | 10053068 | A1 * | 5/2002 | A45B 7/005 | |
| FR | 581768 | A * | 12/1924 | A45B 7/005 | |
| FR | 708617 | A * | 7/1931 | A45B 7/005 | |
| FR | 924000 | A * | 7/1947 | A45B 7/005 | |
| GB | 190923165 | A * | 0/1910 | A45B 7/005 | |
| GB | 269431 | A * | 4/1927 | A45B 7/005 | |
| GB | 1062753 | A * | 3/1967 | A45B 7/005 | |
| HU | FR 440806 | A * | 7/1912 | A45B 7/005 | |

* cited by examiner

UMBRELLA WITH OFF-CENTERED CANOPY

RELATED APPLICATIONS

The present invention was first described in and claims the benefit of U.S. Provisional Application No. 61/928,679, filed Jan. 17, 2014, the entire disclosures of which are incorporated herein by reference.

FIELD OF THE INVENTION

The present invention relates generally to an umbrella having a canopy in an off-centered position to provide enhanced rain protection for a user.

BACKGROUND OF THE INVENTION

No one will doubt the effectiveness of an umbrella for keeping one dry while walking in the rain. Their simple, but effective design has served mankind well over the years with minimal changes to its basic design. However, umbrellas suffer from one (1) common flaw in that the handle and shaft must be positioned away from the body when using. This position places the canopy of the umbrella off to one (1) side of the user, leaving the other side of the user's body at the very edge of the umbrella, or even beyond. This then subjects the user to rain, especially in blowing and driving rain conditions. Accordingly, there exists a need for a means by which umbrellas can provide complete and maximum coverage for all extents of the user's body, in order to eliminate the problems as described above.

SUMMARY OF THE INVENTION

The disadvantages of the prior art are overcome by the present invention in providing an umbrella having a shaft assembly that includes a lower shaft, an upper shaft, an offset hinge assembly disposed therebetween, and a handle. The umbrella also includes a canopy assembly with a plurality of extendable ribs operatively disposed between the distal end of the upper shaft and the runner. The canopy is operatively disposed over the ribs and affixed to a distal end of the upper shaft and the runner wherein the offset hinge assembly is adapted to be selectively positioned in a stowed position in which said canopy can be opened and closed, and in a deployed position in which said open canopy is offset from said handle. The use of the present invention provides an elegant solution for keeping umbrella users dryer, in a manner which is quick, easy, and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
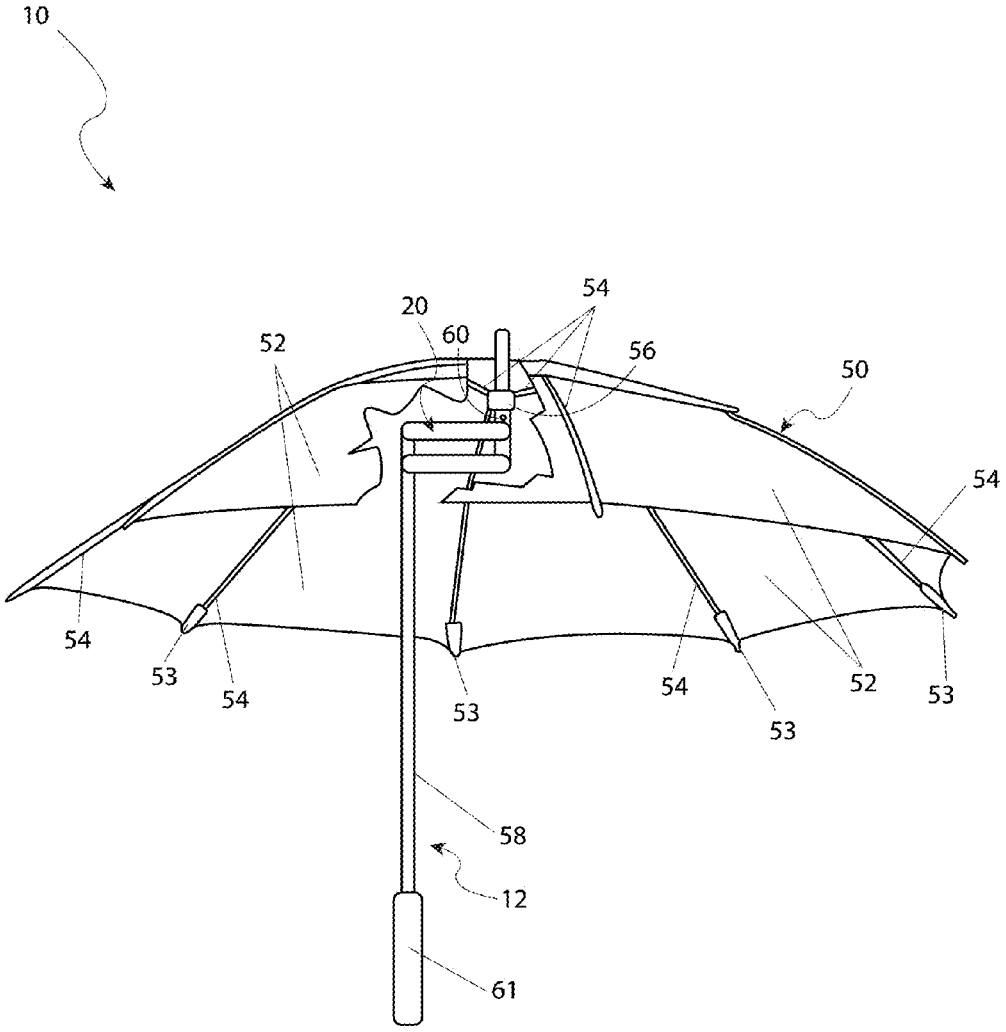
FIG. 1 is a partial break-away perspective view of an umbrella with an off-centered canopy 10, according to a preferred embodiment of the present invention.

10 umbrella with an off-centered canopy
12 shaft assembly
20 offset hinge assembly
22 upper bar
24 lower bar
26*a* first upper bar pin
26*b* second upper bar pin
28*a* first lower bar pin
28*b* second lower bar pin
30 return spring
32*a* first spring fastener
32*b* second spring fastener
34 spring stop
35*a* first tab stop
35*b* second tab stop
36 gap
50 canopy assembly
52 canopy
53 umbrella tip
54 umbrella rib
56 runner
58 lower shaft section
59*a* first lower shaft slot
59*b* second lower shaft slot
60 upper shaft section
61 handle
62 runner spring lock
64*a* first upper shaft slot
64*b* second upper shaft slot
66 spring plunger assembly
68 plunger ball
70 spring plunger aperture
72 spring
74 retaining depression
120 alternate locking hinge
124*a* alternate lower bar
124*b* first arm
124*c* second arm
125 locking spring
126*a* first groove
126*b* second groove
128*b* alternate bar pin
129 locking spring fastener
160 alternate upper shaft section
164*a* first alternate slot
164*b* second alternate slot

DETAILED DESCRIPTION OF THE PREFERRED EMBODIMENT

Figure 2:
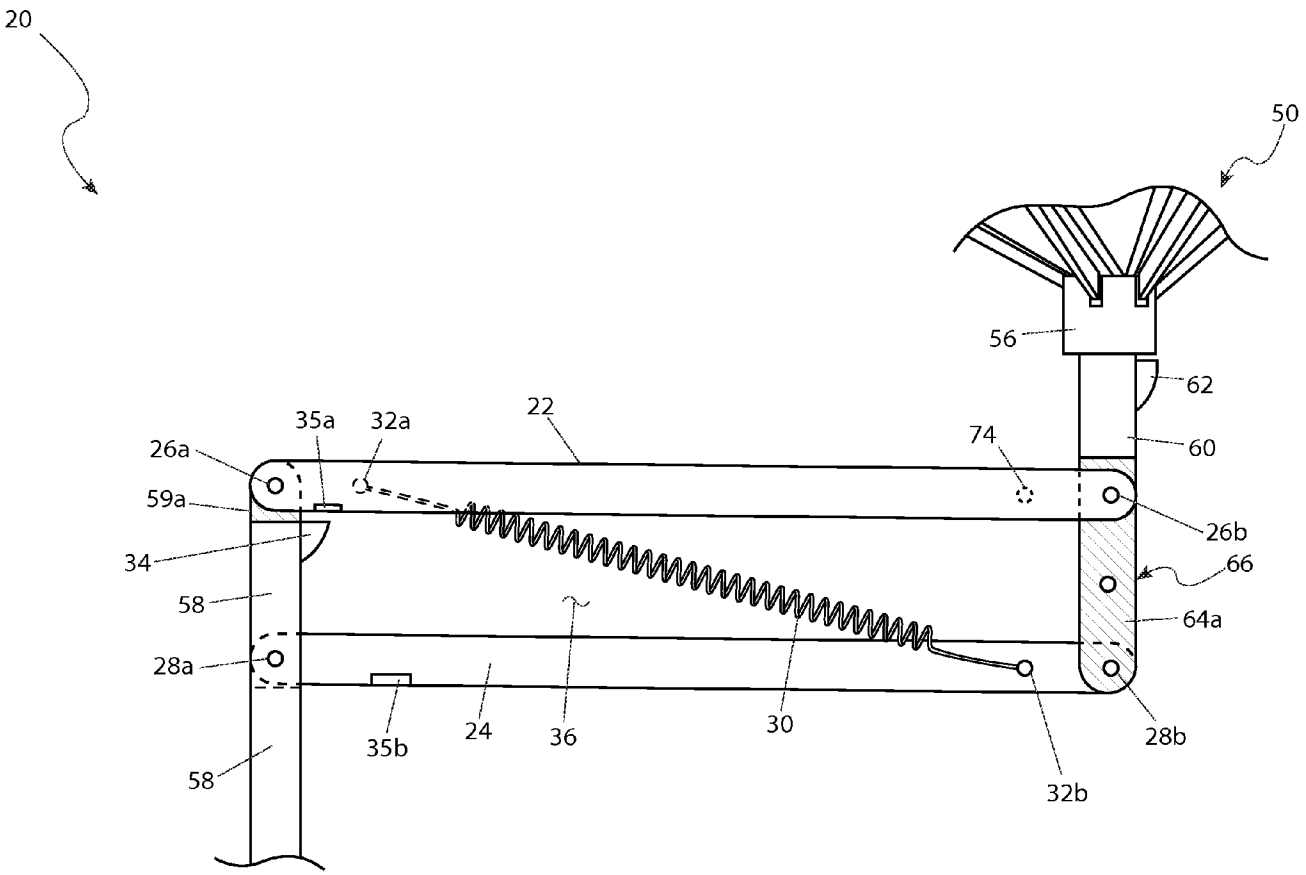
FIG. 2 is a front view of an offset hinge assembly portion 20 of the umbrella with an off-centered canopy 10 depicting a horizontal deployed state, according to a preferred embodiment of the present invention.
Figure 3A:
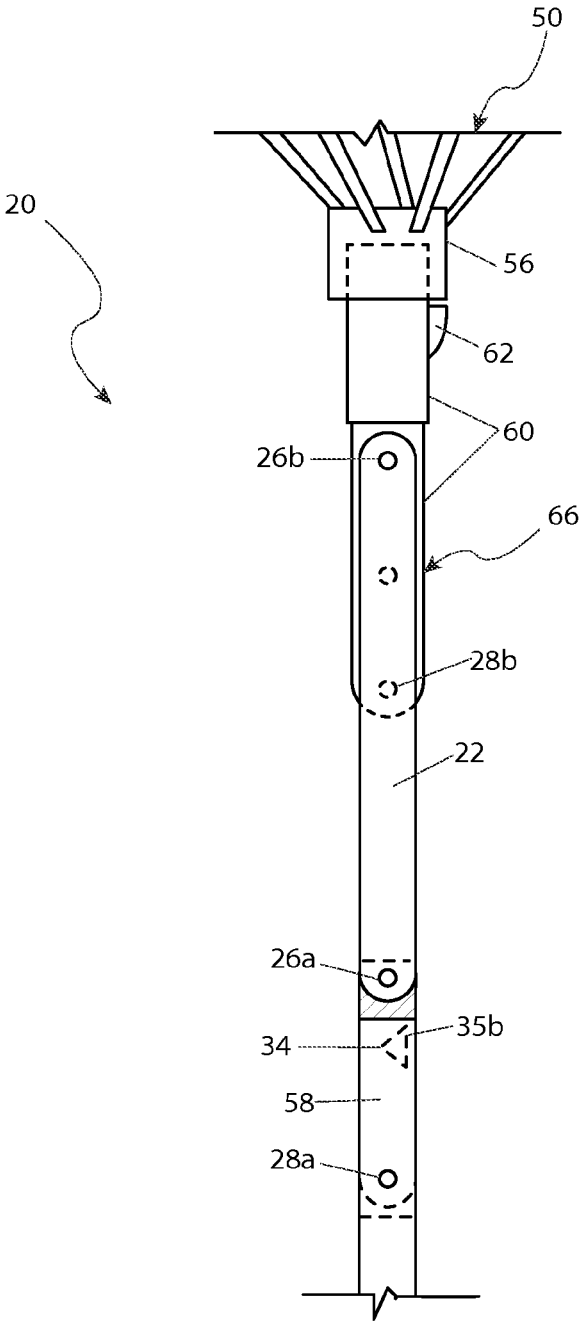
FIG. 3*a* is another front view of the offset hinge assembly portion 20 of the umbrella with an off-centered canopy 10 depicting a vertical state, according to a preferred embodiment of the present invention.
Figure 3B:
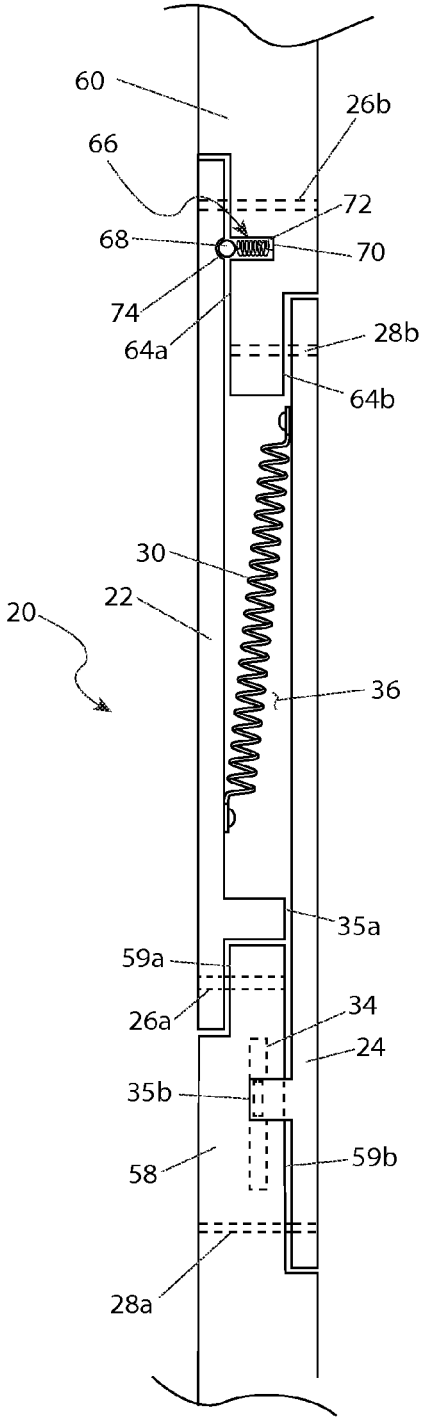
FIG. 3*b* is a side view of the offset hinge assembly portion 20 also depicting a vertical state, according to a preferred embodiment of the present invention.
Figure 4B:
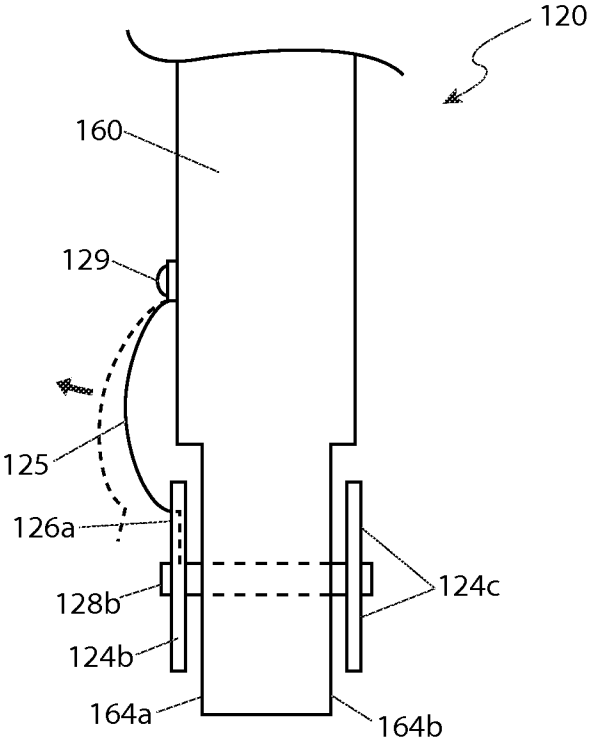
FIG. 4*a* is a front view of an alternate locking hinge portion 120, according to an alternate embodiment of the present invention; and, FIG. 4*b* is a side view of the alternate locking hinge portion 120, according to an alternate embodiment of the present invention.
Figure 4A:
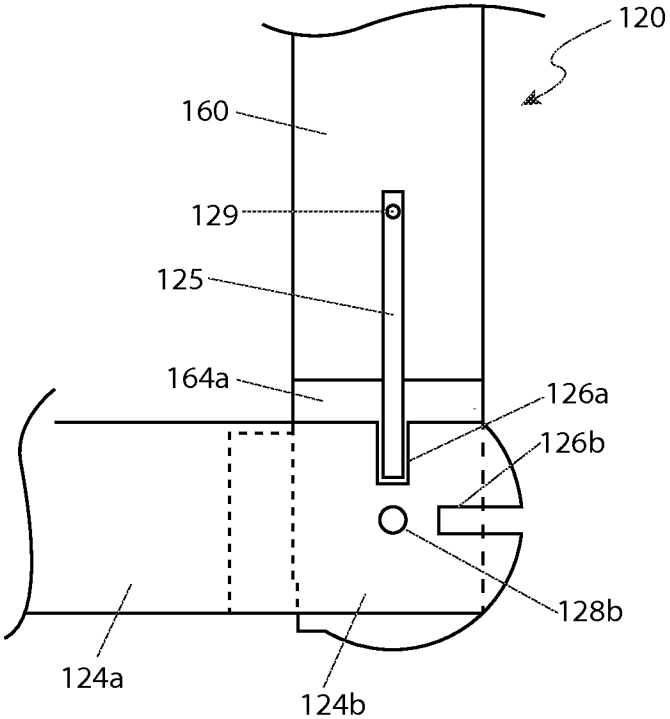

The best mode for carrying out the invention is presented in terms of its preferred embodiment, herein depicted within FIGS. 1 through 3*b*, and in terms of an alternate embodiment, herein depicted within FIGS. 4*a* and 4*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an umbrella (herein described as the "apparatus") 10, which provides an umbrella with a canopy assembly 50 and a shaft assembly 12 and that includes an offset upper shaft section 60 to allow for better positioning of the umbrella canopy 52 over the user to aid in keeping the user dry. The apparatus 10 allows the user to position the umbrella handle 61 in the normal position in front of their torso, while centering the canopy 52 directly overhead.

Referring now to FIG. 1, a partial break-away perspective view of the apparatus 10, according to a preferred embodiment of the present invention, is disclosed. The apparatus 10 comprises a shaft assembly 12 that includes an offset hinge assembly 20 affixed between lower shaft section 58 and upper shaft section 60 portions, and a canopy assembly 50. The canopy assembly 50 further provides a textile canopy 52 having sewn-in umbrella tips 53 providing attachment of outer end portions of respective umbrella canopy ribs 54. The umbrella ribs 54 comprise flexible bow-like members having inward ends being pivotally connected to side surfaces of a vertically sliding runner 56. Furthermore, the apparatus 10 is envisioned to provide various sizes of canopy assemblies 50 having a variety of attractive colors and patterns based upon a user's preference.

Referring now to FIGS. 2, 3*a*, and 3*b*, various views of the offset hinge assembly portion 20 of the apparatus 10 depicting deployed and stowed states, according to a preferred embodiment of the present invention, are disclosed. The offset hinge assembly 20 includes an upper bar 22 and a lower bar 24, both being pivotally attached to the lower shaft 58 via a first upper bar pin 26*a* and a first lower bar pin 28*a* respectively. In like manner, the upper bar 22 and a lower bar 24 are pivotally attached to the upper shaft section 60 via a second upper bar pin 26*b* and a second lower bar pin 28*b* respectively. The pins 26*a*, 26*b*, 28*a*, 28*b* are arranged in such a manner so as to maintain the shaft sections 58, 60 in parallel to each other, as well as maintaining the bars 22, 24 in parallel to each other, thereby forming an inclusive parallelogram when the bars 22, 24 are in the deployed position as seen in FIG. 2.

The shaft sections 58, 60 and bars 22, 24 provide a continuous cylindrical shape when the apparatus 10 is in an upright and stowed position, which allows normal collapsing of the umbrella apparatus 10. The shaft sections 58 60 are preferably of an identical circular cross-section being positioned above and below the offset hinge assembly 20. Each bar portion 22, 24 of the offset hinge assembly 20 has a cross-sectional shape being a semi-circular segment which represents approximately thirty percent (30%) of a circle's area, thereby forming a gap 36 in between the bars 22, 24 as seen in FIGS. 2 and 3*b*. Each bar 22, 24 is abutted against opposing recessed slot portions 59*a*, 59*b*, and 64*a*, 64*b*, along the side surfaces of the respective shaft sections 58, 60. The upper bar 22 and lower bar 24 portions are mounted to the lower shaft section 58 within respective recessed first lower shaft slot 29*a* and second lower shaft slot 29*b* portions via the aforementioned first upper 26*a* and first lower 28*a* bar pins. In like manner, opposite end portions of the upper bar 22 and lower bar 24 portions are mounted to the upper shaft section 60 within respective recessed first upper shaft slot 64*a* and second upper shaft slot 64*b* portions via the aforementioned second upper 26*b* and second lower 28*b* bar pins. When the offset hinge assembly 20 is in the stowed position, the outward-facing surfaces of the bars 22, 24 provide vertically aligned and corresponding circular outer shapes to the shaft sections 58, 60. Then, in this position, the runner portion 56 of the canopy assembly 50 may be operatively slid up or down along the shaft sections 58 and 60 to deploy or collapse the umbrella ribs 54 and canopy 52 in a conventional manner.

The apparatus 10 provides mechanical features to retain the apparatus 10 in a stowed position by engagement of a spring plunger assembly 66 disposed within the upper shaft section 60. The spring plunger assembly 66 includes a plunger ball 68 that is pressed into and captured in a spring plunger aperture 70. A spring 72 disposed within the aperture 70 presses outward on the plunger ball 68 so that a portion of the ball 68 will rest in a retaining depression 74 formed on the inner surface of the upper bar 22. In this manner, when the apparatus 10 is in the stowed position, and the upper bar 22 is in line with the upper and lower shafts 58 and 60, the plunger ball 68 seats in the retaining depression 74 and that provides a spring loaded retention to hold the apparatus 10 in place. To close the umbrella in a normal manner, the user then presses upon a runner spring lock device 62 and slides the runner 56 downwardly to collapse the apparatus 10 when no longer needed for protection from rain.

Additionally, the apparatus 10 includes an internal return spring 30 which expands during deployment of the offset hinge assembly 20. The return spring 30 provides motion dampening as the canopy assembly 50 descends to the offset position. The return spring 30 includes end portions which are affixed to inwardly-facing flat surfaces of the bars 22, 24 using respective first fastener 32*a* and second spring fastener 32*b* portions. The return spring 30 provides a tensile spring device and occupies a gap 36 formed between flat side portions of the bars 22, 24.

Finally, the lower shaft section 58 includes a protruding spring-loaded spring stop 34 disposed along a side surface immediately below the first lower shaft slot 59*a* to prevent the upper and lower bars 22 and 24 from over extending. When moving to the deployed position, as best shown in FIG. 2, the spring stop 34 extends and first tab stop 35*a* in the upper bar 22 contacts the spring stop 34 to prevent further movement of the upper and lower bars 22, 24. Conversely, when returning the apparatus 10 to the stowed position, as seen in FIGS. 3*a* and 3*b*, a second spring tab stop 35*b* disposed at a corresponding position upon the lower bar 24 contacts and collapses the spring-loaded spring stop 34, allowing subsequent downward sliding of the runner 56 portion of the canopy assembly 50 during normal collapsing and stowing of the canopy assembly 50.

Referring now to FIGS. 4*a* and 4*b*, front and side views of an alternate locking hinge portion 120, according to an alternate embodiment of the present invention, are disclosed. The alternate locking hinge 120 provides additional stability to the apparatus 10 being especially useful in windy or otherwise violent weather conditions. The alternate locking hinge 120 provides positional securement of the apparatus 10 equally well in either the stowed or when deployed via mechanical locking of the offset hinge assembly 20. It is understood that the alternate locking hinge 120 may be utilized in addition to, or in lieu of the previously described spring plunger assembly 66 and spring stop 34 portions. The alternate locking hinge 120 is illustrated here for illustration sake, being utilized to secure a relative position of alternate lower bar 124*a* and alternate upper shaft 160 portions of the offset hinge assembly 20; however, it is understood that the alternate locking hinge 120 may be incorporated as an alternate into the other upper bar 22 hinge point at the pivoting joint utilizing pin 26*a* of the offset hinge assembly 20 with equal benefit.

The alternate locking hinge 120 provides an alternate lower bar portion 124*a* which further includes first arm 124*b* and second arm 124*c* portions. The arms 124*b*, 124*c* provide flat parallel protrusions which extend along side surfaces of the alternate upper shaft 160. The alternate lower bar 124*a* is pivotally attached to the alternate upper shaft 160 via the alternate bar pin 128*b*. The first arm 124*b* further comprises first spring groove 126*a* and second spring groove 126*b* features located along a perimeter edge and being spaced approximately ninety (90°) degrees apart. The alternate upper shaft 160 further includes a locking spring 125 being affixed thereto via a spring fastener 129. The locking spring 125 is positioned so as to be in alignment with the spring groove portions 126*a* and 126*b* of the first arm 124*b* as the alternate lower bar 124*a* is rotated about the alternate bar pin 128*b*. Rotation of the alternate lower bar 124*a* relative to the alternate upper shaft 160 provides selective engagement of the spring 125 within either the first 126*a* or second 126*b* spring groove, thereby securing the apparatus 10 in the offset state or vertical state, respectively. The locking spring 125 is envisioned to be an arcuate leaf-type spring being biased inwardly to engage the grooves 126*a*, 126*b* when released. The arcuate shape of the locking spring 125 allows a user to grasp and motion the locking spring 125 outwardly, rotate the alternate lower bar 124*a*, and re-engage the locking spring 125 into a desired groove 126*a*, 126*b*.

The arms 124*b*, 124*c* are positioned along opposing side surfaces of the alternate upper shaft section 160 in a recessed manner within parallel and recessed first alternate slot 164*a* and second alternate slot 164*b* features so as to maintain the combined cylindrical shape of the alternate lower bar 124*a* and the alternate upper shaft section 160 when configured in the stowed position.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIG. 1.

The method of utilizing the apparatus 10 may be achieved by performing the following steps: procuring a model of the apparatus 10 having a desired size and color based upon a user's preference; deploying the canopy assembly 50 from a stowed position by grasping the handle 61 or lower shaft section 58 of the apparatus 10; grasping and sliding the runner 56 upwardly over the offset hinge assembly 20 and onto the upper shaft section 60 until the runner 56 is secured above the runner spring lock 62; deploying the offset hinge assembly 20 to the offset position by grasping the lower 58 and upper 60 shaft sections and applying a sideways force to disengage the spring plunger assembly 66; motioning the upper shaft section 60 outwardly and downwardly until the upper bar 22 obtains a horizontal orientation and contacts the spring stop 34; holding the handle 61 and positioning one's self under the offset canopy portion 52 of the canopy assembly 50; and, benefiting from improved protection from rainfall afforded a user of the present invention 10.

The method of utilizing a model of the apparatus 10 equipped with the alternate locking hinge 120 may be achieved by performing the following extra steps: deploying the canopy 52 and umbrella ribs 54 of the canopy assembly 50 as described above; reconfiguring the offset hinge assembly 20, equipped with the locking hinge 120, to the offset state by grasping and pulling the arcuate locking spring 125 outwardly from the second groove portion 126*b* of the first panel 124*b*, thereby rotationally unlocking the alternate lower bar 124*a* from the alternate upper shaft section 130; rotating the alternate lower bar 124*a* downwardly to a horizontal position; aligning and releasing the locking spring 125 into the first groove 126*a* to secure the apparatus 10 in the offset state; and, utilizing the additional security provided by the alternate locking hinge 120 to provide additional protection in an event of violent inclement weather.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An umbrella, comprising:

a shaft assembly, comprising:

a lower shaft;

an upper shaft;

an offset hinge assembly disposed therebetween; and, a handle;

a canopy assembly, comprising:

a runner slidingly disposed on said shaft assembly;

a plurality of extendable ribs operatively disposed between said distal end of said upper shaft and said runner; and, a canopy operatively disposed over said ribs and affixed to a distal end of said upper shaft;

wherein said offset hinge assembly is adapted to be selectively positioned in a stowed position in which said canopy can be opened and closed, and in a deployed position in which said open canopy is offset from said handle; and, wherein said offset hinge assembly further comprises a deployed securing mechanism for securing said offset hinge assembly in said deployed position, comprising:

a spring stop;

a first tab stop; and, a second tab stop;

wherein said spring stop operatively extends from said lower shaft and engages said first tab stop when said offset hinge assembly is moved to said deployed position; and, wherein said second tab stop engages and drives said spring stop into said lower shaft when said offset hinge assembly is moved to said stowed position.

2. The umbrella of claim 1, wherein said canopy further comprises a plurality of umbrella tips disposed at a circumferential perimeter thereof, wherein each of said tips are adapted to individually engage a distal end of one of said ribs.

3. The umbrella of claim 1, wherein said offset hinge assembly further comprises:

a first bar pivotally attached to said lower shaft at a first lower end and pivotally attached to said upper shaft at a first upper end;

a second bar pivotally attached to said lower shaft at a second lower end and pivotally attached to said upper shaft at a second upper end; and, a return spring attached at a first end to said first bar and at a second end to said second bar;

wherein said return spring provides a mechanical dampening during movement of said offset hinge assembly from said stowed position to said deployed position.

4. The umbrella of claim 1, further comprising a stowed securing mechanism for securing said offset hinge assembly in said stowed position.

5. The umbrella of claim 4, wherein said stowed securing mechanism further comprises a spring plunger assembly, comprising:

a spring plunger aperture disposed in said upper shaft;

a plunger ball operatively disposed and captured within said aperture;

a spring disposed within said aperture and adapted to operatively engage said ball; and, a retainer depression disposed in said first bar;

wherein said spring is adapted to cause said ball to partially extend from said aperture and engage said retainer depression.

6. The umbrella of claim 1, further comprising a spring lock disposed in said upper shaft adapted to selectively engage said runner and lock said runner and said canopy assembly in said open position.

7. An umbrella, comprising:

a lower shaft;

an upper shaft;

an offset hinge assembly having a first bar and a second bar, each said bar disposed between said upper and said lower shaft;

a handle; and, a canopy operatively affixed to a distal end of said upper shaft;

wherein said offset hinge assembly is adapted to be selectively positioned in a stowed position in which said first and said second bars are in alignment with said upper and said lower shafts;

wherein said offset hinge assembly is adapted to be selectively positioned in a deployed position in which said first and said second bars are perpendicular to said upper and said lower shaft and said canopy is offset from said handle; and, wherein said offset hinge assembly further comprises a deployed securing mechanism for securing said offset hinge assembly in said deployed position, comprising:

a spring stop disposed within said lower shaft;

a first tab stop disposed upon said first bar; and, a second tab stop disposed upon said second bar;

wherein said spring stop operatively extends from said lower shaft and engages said first tab stop when said offset hinge assembly is moved to said deployed position; and, wherein said second tab stop engages and drives said spring stop into said lower shaft when said offset hinge assembly is moved to said stowed position.

8. The umbrella of claim 7, wherein said offset hinge assembly further comprises:

said first bar is pivotally attached to said lower shaft at a first lower end and pivotally attached to said upper shaft at a first upper end;

said second bar is pivotally attached to said lower shaft at a second lower end and pivotally attached to said upper shaft at a second upper end; and, a return spring attached at a first end to said first bar and at a second end to said second bar;

wherein said return spring provides a mechanical dampening during movement of said offset hinge assembly from said stowed position to said deployed position.

9. The umbrella of claim 7, further comprising a stowed securing mechanism for securing said offset hinge assembly in said stowed position.

10. The umbrella of claim 9, wherein said stowed securing mechanism further comprises a spring plunger assembly comprising:

a spring plunger aperture disposed in said upper shaft;

a plunger ball operatively disposed and captured within said aperture;

a spring disposed within said aperture and adapted to operatively engage said ball; and, a retainer depression disposed in said first bar;

wherein said spring is adapted to cause said ball to partially extend from said aperture and engage said retainer depression.

11. The umbrella of claim 7, further comprising a spring lock disposed in said upper shaft adapted to selectively engage said runner and lock said runner and said canopy assembly in said open position.

* * * * *